US007062807B2

(12) United States Patent
Conforti

(10) Patent No.: US 7,062,807 B2
(45) Date of Patent: Jun. 20, 2006

(54) INFANT MAT

(76) Inventor: Carl J. Conforti, P.O. Box 6315, Fall River, MA (US) 02724

( * ) Notice: Subject to any disclaimer, the term of this patent is extended or adjusted under 35 U.S.C. 154(b) by 0 days.

(21) Appl. No.: 10/911,046

(22) Filed: Aug. 4, 2004

(65) Prior Publication Data

US 2005/0005361 A1 Jan. 13, 2005

Related U.S. Application Data

(63) Continuation of application No. 10/208,463, filed on Jul. 30, 2002, now Pat. No. 6,785,921.

(60) Provisional application No. 60/389,175, filed on Jun. 17, 2002.

(51) Int. Cl.
*A47D 5/00* (2006.01)

(52) U.S. Cl. ..... 5/655; 5/484; 5/487

(58) Field of Classification Search ..... 5/655–657, 5/417, 420, 484, 486, 487, 502, 947; 604/358, 604/386, 393, 397
See application file for complete search history.

(56) References Cited

U.S. PATENT DOCUMENTS 2,735,737 A * 2/1956 Hancock ..... 108/50.17
3,761,973 A * 10/1973 Leventhal ..... 5/484
4,216,951 A * 8/1980 Griffin ..... 5/655
4,627,426 A * 12/1986 Wegener et al. ..... 604/356
4,876,970 A * 10/1989 Bolduc ..... 108/35
5,987,677 A * 11/1999 Betker ..... 5/655
6,209,156 B1 * 4/2001 Hershey ..... 5/490
6,378,445 B1 * 4/2002 Willard et al. ..... 108/115
6,405,394 B1 * 6/2002 Rosenberg ..... 5/655
6,785,921 B1 * 9/2004 Conforti ..... 5/655
6,889,397 B1 * 5/2005 Rosenberg ..... 5/655
6,928,680 B1 * 8/2005 Cai et al. ..... 5/655
2002/0166172 A1 * 11/2002 Rosenberg ..... 5/420
2005/0005361 A1 * 1/2005 Conforti ..... 5/655
2005/0108824 A1 * 5/2005 Rosenberg ..... 5/655
2005/0177942 A1 * 8/2005 Finn ..... 5/499
2005/0278855 A1 * 12/2005 Welch ..... 5/655
2005/0278856 A1 * 12/2005 Welch ..... 5/655

* cited by examiner

*Primary Examiner*—Robert G. Santos

(57) ABSTRACT

An automatically-opening infant mat that is movable between an open position and a closed position includes a water-resistant flexible material sized to have an infant, at least from the infant's head to the infant's buttocks, placed on the material while the mat is in the open position, a cushion coupled to the material to be disposed under a portion of the infant's body while the mat is in the open position and the infant is placed on the material, and a resilient bias member coupled to the material and configured to bias the material to an open position and to be reversibly moved to a closed position.

29 Claims, 7 Drawing Sheets

INFANT MAT

CROSS-REFERENCE TO RELATED ACTIONS

This application is a continuation of U.S. patent application Ser. No. 10/208,463 filed Jul. 30, 2002, now U.S. Pat. No. 6,785,921, entitled "Infant Mat" which claims the benefit of U.S. Provisional Application Ser. No. 60/389,175 filed Jun. 17, 2002 and entitled "Infant Pad."

FIELD OF THE INVENTION

The invention relates to pads for accommodating infants and more particularly for pads on which to place an infant during a diaper change.

BACKGROUND OF THE INVENTION

It is often desirable to place an infant, from newborn to toddler (typically up to about three years old), on a pad for various reasons, including to change the child's diaper or clothes. The child may also be placed on a mat for other reasons, including to provide a cleaner surface than that available (e.g., if outdoors such as on grass or the ground). Children that are not placed on a pad or mat may be subjected to dirty, unsanitary conditions that are undesirable.

Dedicated or makeshift change pads currently exist. For example, pads exist that are designed for use in the home and include a contoured foam cushion (curved upward at the edges along the length of the cushion to help retain the child on the cushion) and a cloth cover. Portable change mats exist that can be folded for storage and transport and unfolded for use. Also, persons can make their own pad or barrier for a child, e.g., by laying a blanket or towel on the ground, etc. and lying the child on the blanket or towel.

SUMMARY OF THE INVENTION

In general, in an aspect, the invention provides an automatically-opening infant mat that is movable between an open position and a closed position. The includes a water-resistant flexible material sized to have an infant, at least from the infant's head to the infant's buttocks, placed on the material while the mat is in the open position, a cushion coupled to the material to be disposed under a portion of the infant's body while the mat is in the open position and the infant is placed on the material, and a resilient bias member coupled to the material and configured to bias the material to an open position and to be reversibly moved to a closed position.

Implementations of the invention may include one or more of the following features. The mat further includes a closure coupled to at least one of the material and the bias member and configured to retain the mat in the closed position. The closure is configured to be released using one hand. The mat further includes a plurality of disposable panels of material detachably coupled to the material. The mat further includes a toy configured to automatically extend from the material, within at least one of sight and reach of the infant while lying on the material, when the mat is moved from the closed position to the open position.

Implementations of the invention may also include one or more of the following features. The mat further includes a toy-attaching mechanism configured to couple to a toy. The toy-attaching mechanism is configured to automatically extend from the material when the mat is moved from the closed position to the open position. The bias member is configured to be at least one of rolled, twisted, and folded into the closed position from the open position. The bias member is coupled to the material about a perimeter of the material while the mat is in the open position. The mat comprises a plurality of pieces.

In general, in another aspect, the invention provides an infant mat including a flexible material sized to have an infant placed on the material while in an open position, and configured to be manipulated to a closed position having a smaller perimeter than the material while in the open position, a cushion coupled to the material to be disposed under a portion of the infant's body while the material is in the open position and the infant is placed on the material, and expanding means coupled to the material for causing the material to expand to the open position in response to an absence of forces restraining the material from opening.

Implementations of the invention may include one or more of the following features. The mat further includes closure means coupled to the material for restraining the material in the closed position. The mat further includes toy means, coupled to at least one of the material and the expanding means, for popping up within at least one of reach and sight of an infant placed on the material if the material moves from the closed position to the open position. The mat further includes means, coupled to and disposed over the material, for providing disposable surfaces on which to place the infant.

Various aspects of the invention may provide one or more of the following advantages. A portable mat on which to lie an infant can be easily opened. A portable mat on which to lie and infant can be opened with one hand. An infant mat can open to its full open configuration automatically. A portable change mat can accommodate a full length of an infant in an open position and be compact for storage and travel in a closed position. Surfaces underlying an infant being changed can be protected from being soiled. Infants can be protected while being changed from unsanitary conditions of underlying surfaces. An infant change mat can be protected from being soiled during changing of an infant on the mat. Infants can use a change mat and be protected from acquiring germs, etc. from prior users of the change mat. Disposable panels/liners can be provided on an infant mat. Infants can be provided with a toy or other entertainment or diversion while on a change mat. Persons changing an infant on a change mat according to the invention may be hindered less by the infant than if using a change mat not in accordance with the invention. An infant mat can be closed/collapsed for compact storage and/or transport. An infant mat can be made compact while closed and have a semi-rigid shape while open.

These and other advantages of the invention, along with the invention itself, will be more fully understood after a review of the following figures, detailed description, and claims.

DETAILED DESCRIPTION OF PREFERRED EMBODIMENTS

At least some embodiments of the invention provide techniques for assisting a person to change an infant in a convenient, infant-comfortable, sanitary manner. Preferably, an infant mat includes a resilient material having a spring bias to urge the mat into an open position. The mat may be opened by releasing a constraint holding the mat in a closed position, allowing the resilient material to automatically open the mat. In the open position, the mat preferably is large enough to accommodate the entire length and width of the infant. The mat preferably includes a water-resistant or water-proof material over at least a portion of the mat in the open position where such a material will likely be useful. The mat also preferably includes a cushion to provide comfort and support to the child's head and possibly other portions of the child's body. Diversions for the infant are preferably provided, or provided for, by the mat, including incorporated toys and/or visual distractions, and/or means for attaching a toy or other item to the mat. Also, disposable sheets are preferably provided that may be removed and discarded after each use of the mat. Other embodiments are within the scope and spirit of the invention as reflected in the appended claims.

Figure 1:
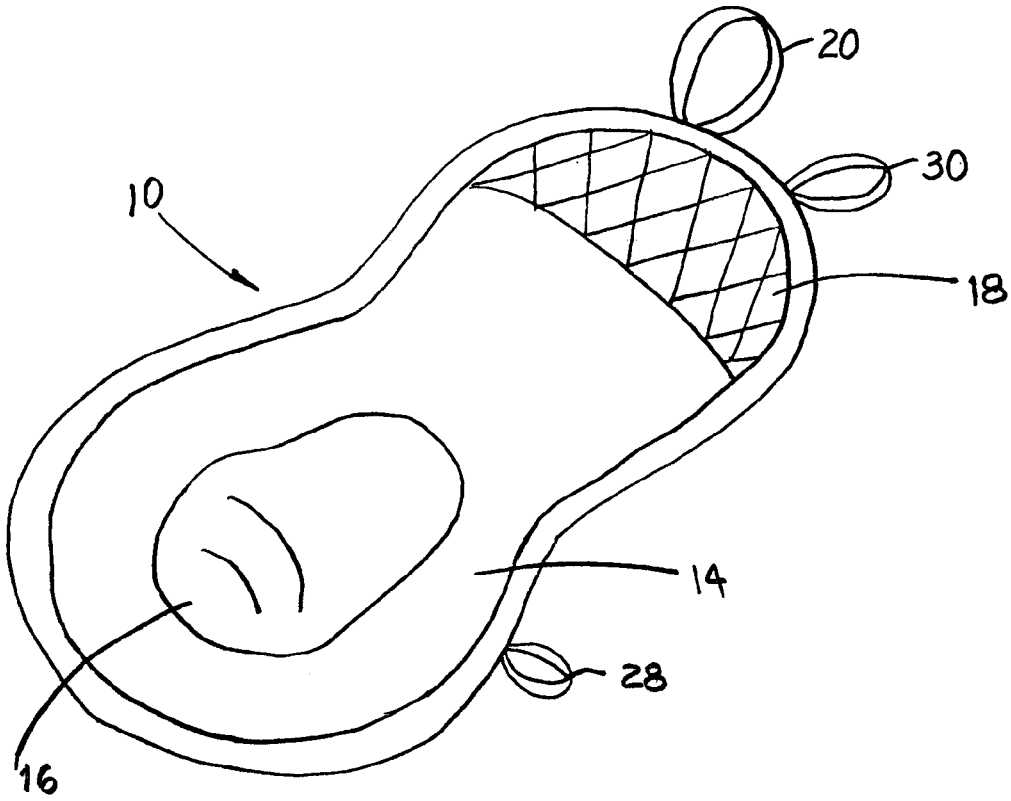
FIG. 1 is a top view of an automatically-opening infant mat in an open position.
Figure 2:
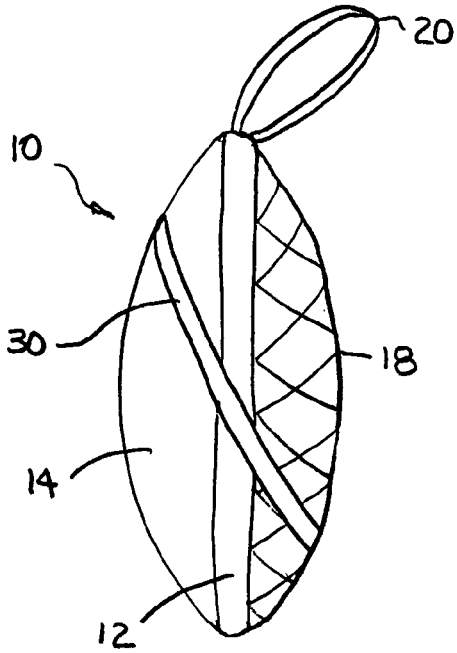
FIG. 2 is a side view of the mat shown in FIG. 1 in a closed position.

Referring to FIGS. 1–2, a self-opening change mat 10 includes a resilient perimeter rod 12, a sheet 14, a cushion 16, a pocket 18, and a handle 20. The mat 10 is configured to lie substantially flat while in the open position shown in FIG. 1 and to be twisted to the closed position shown in FIG. 2. Depending on how the mat 10 is twisted into the closed position, the pocket 18 may be disposed internally or externally when in the closed position. As shown in FIG. 2, the mat 10 is in the closed position such that the pocket 18 is an external pocket. The pocket 18 preferably comprises a water-resistant material configured in a mesh pattern to permit viewing of contents of the pocket 18 without opening the pocket 18.

Figure 3:
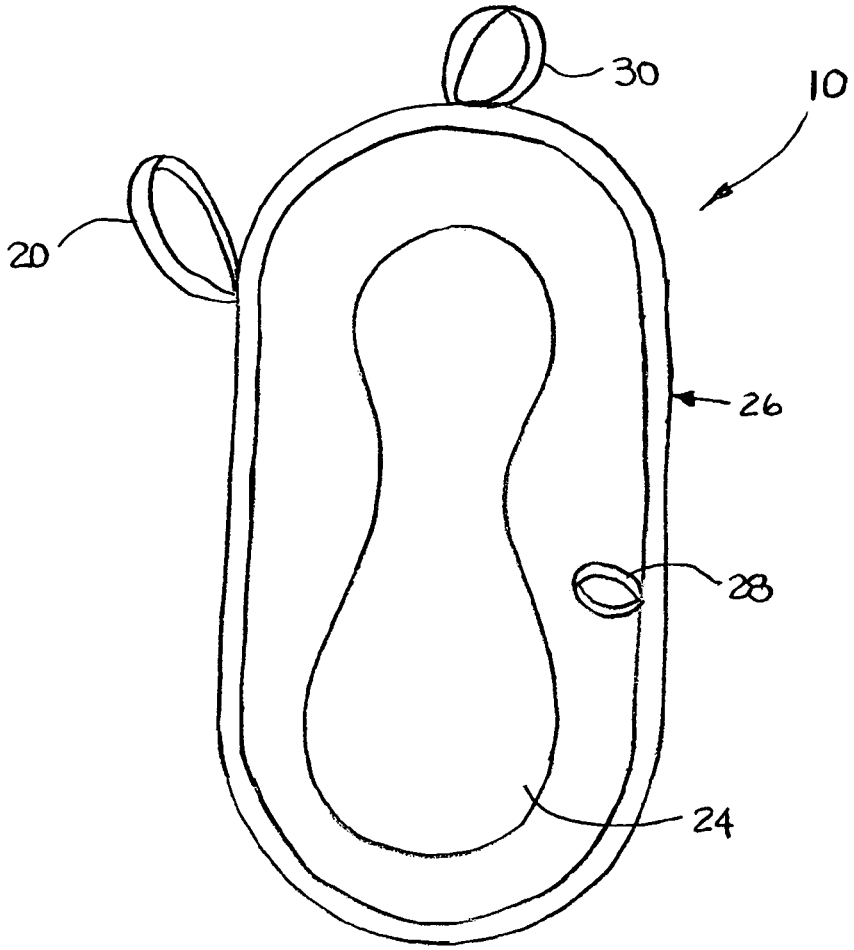
FIG. 3 is a top view of another infant mat in an open position.

The rod 12 is configured to be repeatedly twisted into the closed position, and to be biased toward the open position while in the closed position. The rod 12 is made of a resilient material such as a plastic, or a metal. The rod 12 can be configured in various shapes, such as to form a perimeter resembling an "8" as shown in FIG. 1, or an oval rod 22 as shown in FIG. 3, or a rectangle, or a circle, etc. The rod 12 may also have various cross-sectional shapes, such as circular or flat, and of various sizes such as a thin, solid wire, or a larger, hollow tube. The rod 12 is configured, e.g., molded or assembled, to be biased toward the open, substantially planar, position. Thus, if not held in the closed or other position, then the rod 12 will tend to spring into the open position, thus self-opening the mat 10. The rod 12 is disposed within, e.g., sewn into, the sheet 14 to spread the sheet 14 in the open position.

The sheet 14 preferably provides a comfortable, functional surface on which to place an infant while changing the infant's diaper, clothes, etc. The sheet 14 is preferably made of a water-resistant or waterproof material such as a coated nylon. The size of the sheet 14 is configured such that the sheet 14 will be substantially taut while the mat is in the open position. The sheet 14 is also sized to have an infant, preferably from at least the infant's head to the infant's bottom (buttocks), placed on the mat 10. A perimeter of the sheet 14 may be smaller than a perimeter of the rod 12 if the rod 12 is not disposed in the sheet 14 such that the sheet 14 may inhibit the rod 12 from expanding to its full potential. The shape of the sheet 14, however, is preferably substantially similar to that of the perimeter of the rod 12.

The cushion 16 is disposed and configured to provide padding to an infant placed on the mat 10. Preferably, the cushion 16 is disposed to provide padding to the infant's head while lying on the mat 10. As shown in FIG. 3, a cushion 24 of a mat 26 may extend along a significant portion of the length of the mat 26, providing padding for portions of the infant in addition to the infant's head. Referring again to FIG. 1, the cushion 16 may be flat or contoured, etc., e.g., to cradle the infant's head or provide other support or to inhibit the infant from rolling off the mat 10. The cushion 16 may be made of, e.g., foam, or of a gel such as a heat-sensitive gel that is configured to transform from a liquid to a spongy solid upon application of body heat from the infant. Thus, the gel can conform to the infant's body and solidify into a supportive, padding custom-fit to the infant.

The mat 10 also includes the handle 20 for carrying the mat 10, a toy-attaching loop 28, and a closure loop 30. The handle 20 may be made of an appropriate material such as the same material as the sheet 14 or the pocket 18. The handle 20 is preferably configured as a loop attached to the sheet 14 and sized to allow an adult's hand to fit through the loop. The toy-attaching loop 28 is configured to have a toy clipped to the loop 28 within reach of the infant while lying on the mat 10. The loop 28 may also be made of the same material as the sheet 14, or another material such as a cloth. The closure 30 is configured to wrap around the mat 10 as shown in FIG. 2 to help retain the mat 10 in the closed position. Preferably, the closure 30 is made of an elastic material that can be stretched to fit around the closed mat 10 to hold the mat 10 closed. The closure 30 is preferably configured to be released using one hand. The closure 30 can be attached to the sheet 14 and/or the rod 12 (e.g., if the rod 12 is not enclosed by the sheet 14).

The mat 10 can be assembled as follows. The cushion 16 is sewn into and/or to the sheet 14 in a position where the infant's head will be placed. A passage is sewn into the sheet 14 for receiving the rod 12, with the passage not being sewn completely around the sheet's perimeter yet. The rod 12 is passed into the passage and ends of the rod 12 are connected to each other (although they need not be) and the passage is completed (e.g., sewn shut), enclosing the rod 12. The rod 12 may also be sewn to the sheet 14. The pocket 18, the handle 20, the toy-attaching loop 28 and the closure loop 30 are all sewn to the mat 10 in the positions shown in FIG. 1.

Referring to FIGS. 1–2, the mat 10 can be used for convenient storage/transport and easy opening. When closed as shown in FIG. 2, the mat 10 can be stored without requiring much room (e.g., in a diaper bag), carried conveniently (e.g., by the handle 20). The mat 10 can be opened easily, e.g., using one hand to release the closure 30 (e.g., unwrap an elastic, unbutton a button, separate hook-and-loop pieces, etc.) and allow the rod 12 to actuate to self-open the mat 10 (or possibly influencing the rod 12 such as by shaking the mat 10 or tossing the mat 10 on the ground). When open, an infant can be placed on the mat 10, preferably with the infant's head resting on the cushion 16. The mat 10 can be closed by twisting the rod 12 to collapse the mat 10, and preferably held closed by wrapping the closure 30 around the closed mat 10.

Numerous variations to the mat 10 are possible and within the scope of the invention, as well as numerous other features that may be included with the mat 10. For example, the passage for the rod 12 need not be continuous around the mat's perimeter; the passage could be a series of loops through which the rod 12 is passed. Several other variations and features are discussed below.

Figure 4:
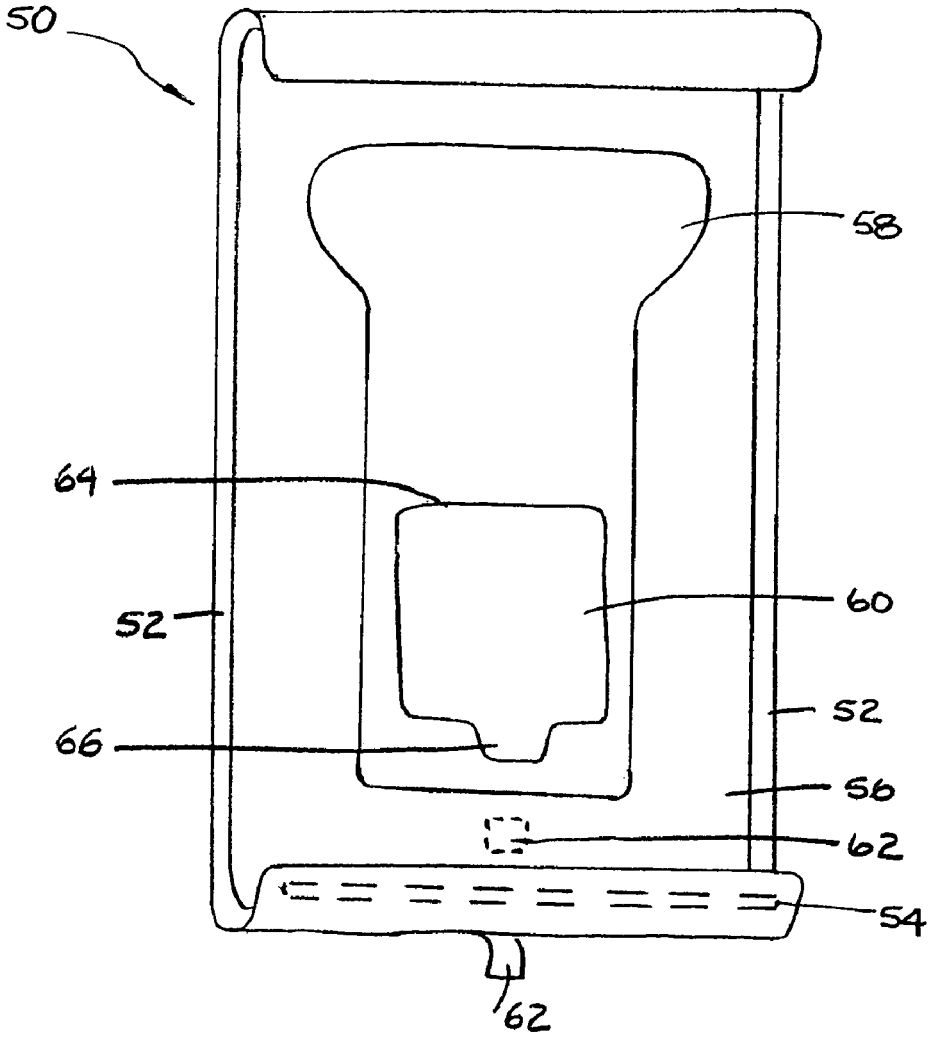
FIG. 4 is a top view of another infant mat in an open position.

Referring to FIG. 4, a mat 50 includes two bias members 52, a stiffener 54, a sheet 56, a cushion 58, a tissue pad 60, and a closure mechanism 62. The sheet 56 and the pad 58 are similar to the sheet 14 shown in FIG. 1 and the pads 16, 24 shown in FIGS. 1, 3. The pad 58 is shaped differently than the pads 16, 24 but may be of similar materials, and may have similar features such as a contour to support an infant's head and/or inhibit the infant from rolling off of the mat 50. The closure mechanism 62 is shown as a hook-and-loop fastener combination although other forms of closures are acceptable (e.g., an elastic band, a snap, a buckle, a button, tie strings, etc.).

The two bias members 52 and the stiffener 54 are configured to bias the mat 50 into the open position shown in FIG. 4. The bias members 52 may be, e.g., wires or flat springs or flexible rods with a naturally straight shape, and are disposed along the length of the mat 50 on opposite edges. The stiffener 54 is disposed at one end of the mat 50 extending between the members 52 to separate the bias members 52 to help define the open shape of the mat 50. Another stiffener may be provided at the end opposite the end having the stiffener 54 to help define the mat's open shape. The stiffener 54 may also be disposed between the ends of the mat 50.

The tissue pad 60 provides a set of disposable panels/liners of paper. Several panels are disposed on top of each other and attached along an edge 64. The panels are made of a thin, preferably (although not necessarily) water-resistant or water-proof material such as a coated paper (e.g., tissue paper) or a plastic. The panels each include a tab 66 for gripping by a user to help tear the sheets from the edge 64. In use, the user can place the infant's head on the cushion 58 and the infant's bottom on the tissue pad 60. The top tissue panel helps to keep urine and/or feces from the infant from reaching the sheet 56 or other underlying tissue sheets. The user can remove the top panel (or any desired panel), from the pad 60 by pulling on the tab 66 to tear the panel from the edge 64. Thus, a clean tissue panel/liner may be available for the next usage of the mat 50. The tissue pad 60 is preferably replaceable/refillable, e.g., by having a hard bottom layer such as a piece of cardboard and a loop or pocket on the mat 50 for receiving the hard bottom layer.

Figure 5:
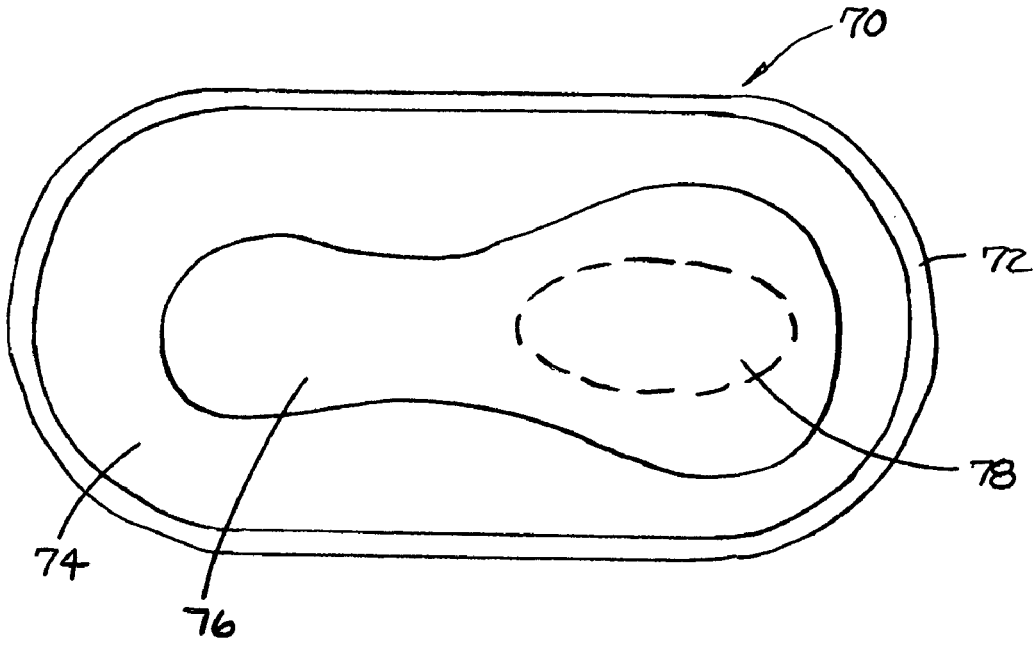
FIG. 5 is a top view of an infant mat including a heating element.
Figure 6:
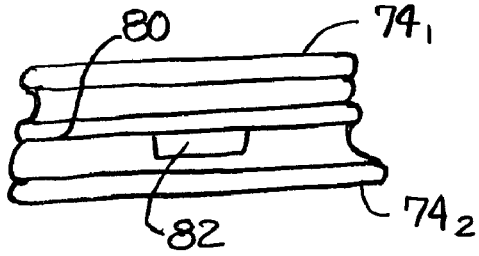
FIG. 6 is a cross-sectional view of a portion of the mat shown in FIG. 5 showing the heating element.

Referring to FIGS. 5–6, a mat 70 includes a bias member 72, a sheet 74, a cushion 76, and a heating element 78. As shown in FIG. 6, the sheet 74 includes multiple, separated layers $\mathbf{74}_1$, $\mathbf{74}_2$. Between the layers $\mathbf{74}_1$, $\mathbf{74}_2$ is disposed the heating element 78 that includes a foil sheet 80 and a thermo-electric heater 82. The heater 82, such as a ceramic element, is configured to convert electricity (preferably direct-current electricity) to heat and provide the heat to the foil sheet 80. The foil sheet 80 is configured to conduct the received heat to disburse the heat over the area of the sheet 80 (FIG. 5) to warm an infant placed on the mat 70. Electricity can be provided to the heater 82 via a battery (not shown), and can be provided in response to activation of a switch (not shown), that may be automatically activated upon opening of the mat 70.

Figure 7:
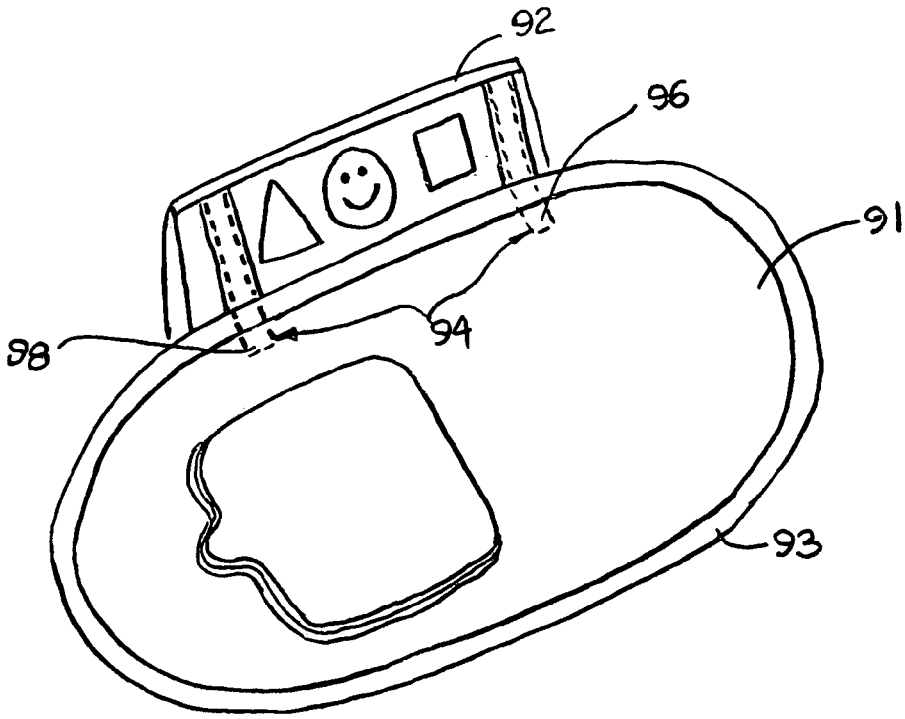
FIG. 7 is a perspective view of an infant mat, in an open position, that includes a pop-up toy.

Referring to FIG. 7, a mat 90 includes a sheet 91, a bias rod 93, and an attached toy 92. The toy 92 is disposed at an edge of the mat 90, although other positions are acceptable. Preferably, although not necessarily, the toy 92 is configured to pop up automatically upon opening of the mat 90. For example, the toy 92 may include a bias mechanism 94 that includes two bias arms 96, 98. The arms 96, 98 are resilient L-shaped pieces in their natural positions, and are configured to be flexed to a closed position that is relatively flat. While the mat 90 is closed, the arms 96, 98 are biased toward the L-shaped position shown in FIG. 7 such that when not restrained, e.g., upon opening of the mat 90, the arms will cause the toy 92 to pop up automatically for viewing by an infant placed on the mat 90. While shown as separate pieces, the arms 96, 98 may be a part of a single piece, and may be made of materials and configurations such as those discussed above. Preferably, the toy 92 will be within sight and/or reach of the infant while the infant is lying on the mat 90. Also, while the toy 92 and the bias mechanism are shown coupled to the sheet 91, the toy and/or the bias mechanism 94 may be coupled to the sheet 91 and/or the bias rod 93.

Figure 8:
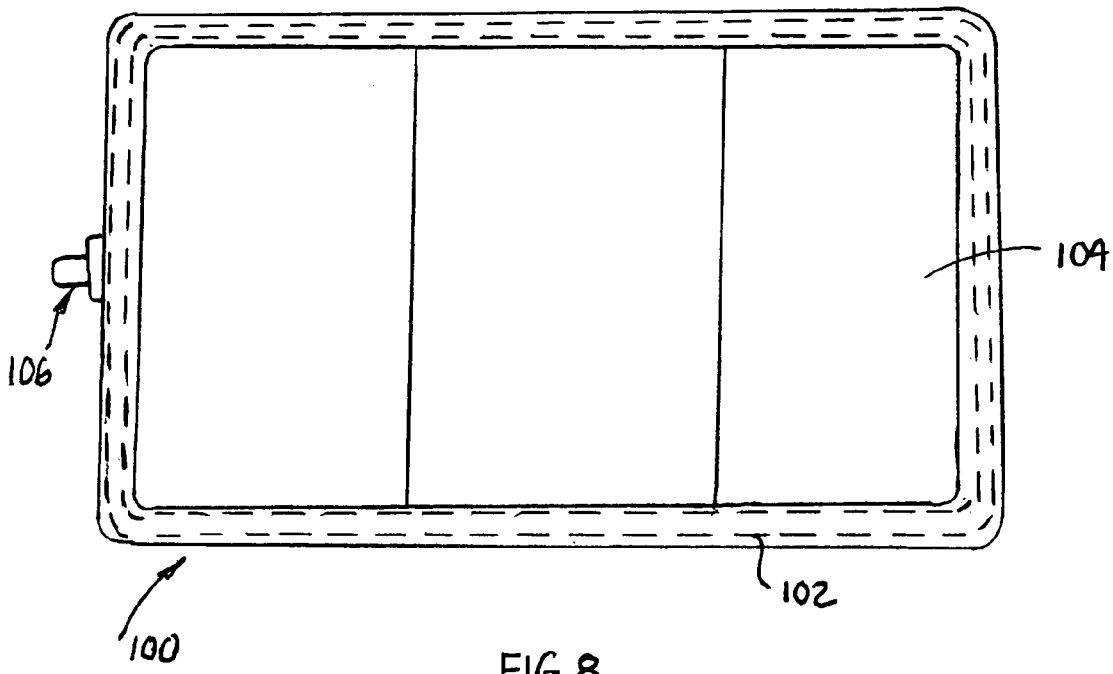
FIG. 8 is a top view of another infant mat in an open position.
Figure 9:
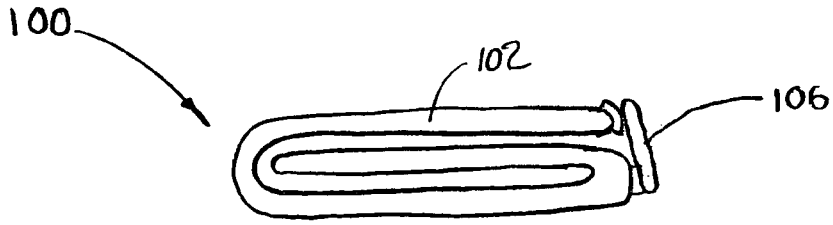
FIG. 9 is a side view of the infant mat shown in FIG. 8 in a closed position.

Referring to FIGS. 8–9, a mat 100 is configured to be folded closed and to open automatically when not restrained. The mat 100 includes a bias member 102, a sheet 104, and a closure 106. The bias member 102 is configured as an incomplete loop and is configured to be folded in three sections as shown in FIG. 9. The bias member 102 can be configured to be folded in other numbers of sections, such as two. The closure mechanism 106 is configured and disposed to help keep the mat 100 in the closed position shown in FIG. 9 and to be released using one hand (e.g., a hook-and-loop fastener, a snap, a button, etc.).

Figure 10:
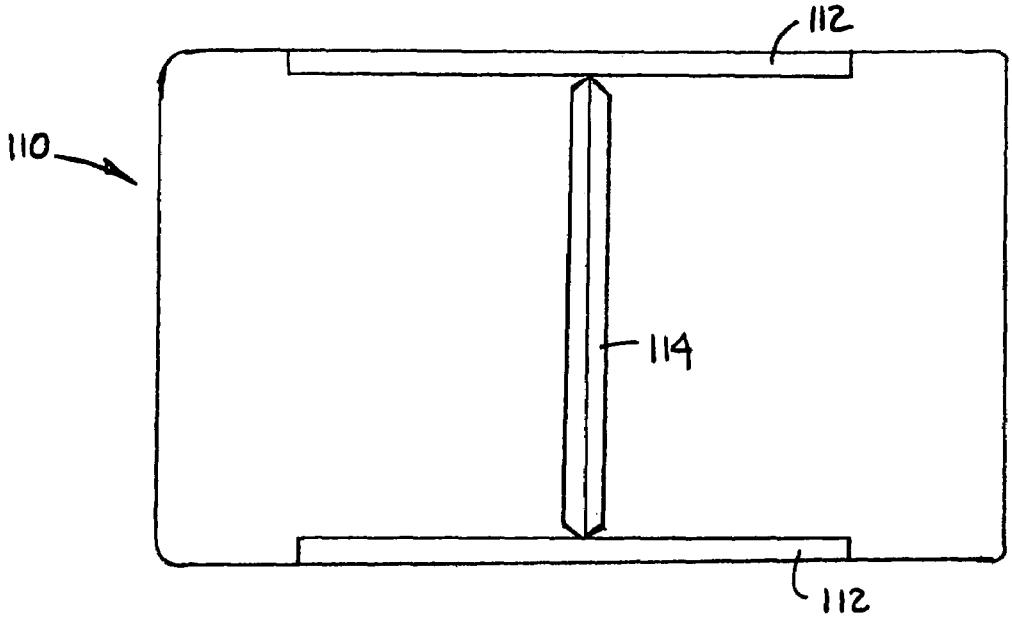
FIG. 10 is a top view of another infant mat in an open position.

Referring to FIG. 10, a mat 110 includes two bias members 112 disposed along opposite edges of the mat 110. The bias members 112 are configured to be folded in two to a closed position. A stiffener 114 is provided to space the bias members 112 to help ensure that the mat 110 opens to a size for receiving an infant. The stiffener 114 may also be configured as a spring-biased hinge that can fold in two and be biased toward an open, substantially-flat position as shown in FIG. 10. Alternatively, the stiffener 114 may be configured as a spring-biased hinge and the bias members 112 may be configured as non-biased stiffeners to help provide the desired shape for the mat 110.

Figure 11:
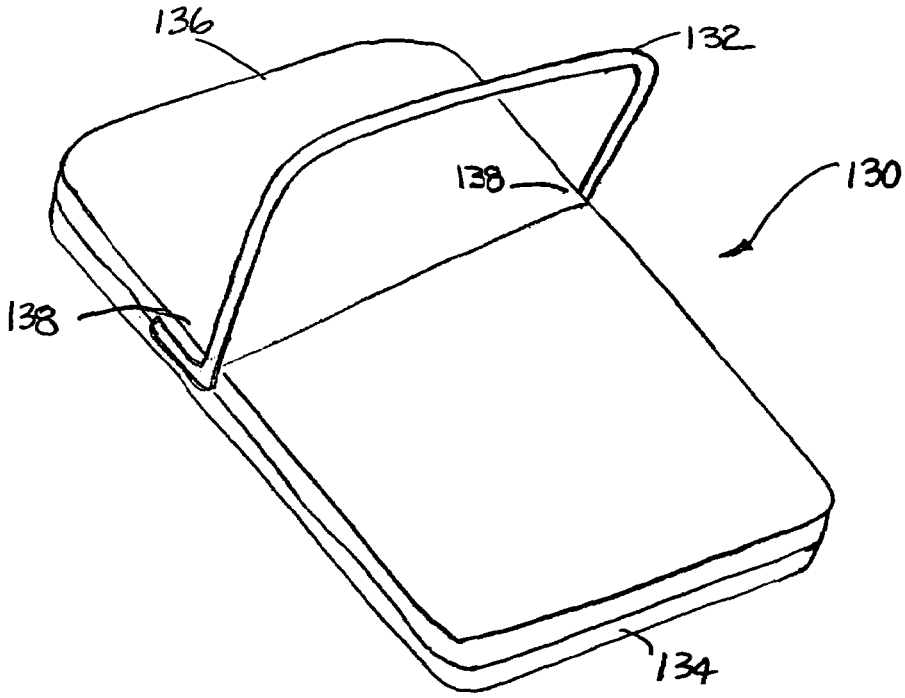
FIG. 11 is a perspective view of an infant mat, in an open position, that includes a pop-up toy attaching mechanism.

Referring to FIG. 11, a mat 130 includes a toy-attaching mechanism 132 disposed between ends 134, 136 of the mat 130. The mechanism 132 is configured with a spring bias toward the open position shown in FIG. 11, but such that the mechanism can be collapsed as indicated by arrows 138 to a closed position to lay substantially flat. When not restrained, however, the bias of the mechanism 132 opens the mechanism 132. The mechanism 132 is configured to have a toy attached to it within reach of an infant placed on the mat 130.

Features of the various mats shown may be interchanged among the mats. For example, the roll-up feature and/or the tissue pad 60 of the mat 50 shown in FIG. 4 can be used in other of the mats shown. Also, for example, closure mechanisms can be interchanged or combined such that elastic closures and/or hook-and-loop fasteners can be used in the mats. Still other embodiments, variations and combinations are also possible and are included within the scope and spirit of the appended claims.

What is claimed is:

1. An infant change mat comprising:

a body sized to receive an infant, the body having a length at least about a length of an infant from the infant's head to the infant's buttocks and a width that is wider than about a width of a torso of the infant to accommodate the infant lying on the infant's back on the body; and a cache of protective covering material connected to the body and configured to be disposed under at least a portion of the infant when the infant is disposed on the mat and to have a first portion of the cache be disposed above a portion of the body and under the at least a portion of the infant during a first usage of the mat for changing the diaper of the infant, be soiled, and be discarded, and to have a second portion of the cache be disposed above the portion of the body and under the at least a portion of the infant during a second usage of the mat for changing another diaper of the infant, be soiled, and be discarded;

wherein at least one of the body and the cache of protective covering material is configured to inhibit the infant from contacting a surface on which the mat is disposed;

wherein the second portion is disposed to inhibit soiling of the second portion during the first usage of the mat; and wherein the body and the cache are configured to be portable.

2. The mat of claim 1 wherein the cache of protective covering material is configured to facilitate separation of the first portion from the second portion.

3. The mat of claim 1 wherein the cache of protective covering material comprises a plurality of selectively-removable sheets.

4. The mat of claim 3 wherein at least some of the sheets are disposed over other ones of the sheets when disposed in the cache.

5. The mat of claim 4 wherein the cache is a pad of the sheets disposed in overlying relation and attached to an edge of the pad.

6. The mat of claim 1 wherein the cache is removably connected to the body.

7. The mat of claim 1 wherein the length of the body is larger than, but about, an entire length of the infant.

8. The mat of claim 1 wherein the cache of protective covering material is configured to inhibit human waste from passing through the cache of protective covering material.

9. The mat of claim 1 wherein the cache of protective material is disposed over a portion of the body.

10. The mat of claim 1 wherein the body is collapsible such that the body can be changed from an open position to a closed position and from the closed position to the open position wherein portions of the body overlie each other in the closed position such that the body occupies a smaller area in the closed position.

11. The mat of claim 1 further comprising a dispenser configured to dispense the cache, wherein the dispenser is removably connected to the body and configured to be portable.

12. The mat of claim 11 wherein the dispenser is slidably received by the body.

13. The mat of claim 1 wherein, during the first usage, the first portion of the cache is disposed under the at least a portion of the infant and above the portion of the body and the second portion of the cache is disposed under the first portion of the cache and above the portion of the body.

14. The mat of claim 13 wherein the cache comprises a plurality of separate, stacked, disposable sheets.

15. An infant change mat comprising:

a body sized to receive an infant, the body having a length at least about a length of an infant from the infant's head to the infant's buttocks and a width that is wider than about a width of a torso of the infant to accommodate the infant lying on the infant's back on the body; and cover means, connected to the body, for covering at least a portion of the body between the infant's buttocks and the body with separable portions of water-resistant protective covering material, each portion of the material configured to inhibit material from a diaper of the infant from reaching the body, at least some of the separable portions overlying each other;

wherein the body and the cover means are configured to be portable.

16. The mat of claim 15 wherein the separable portions of the cover means are configured to be separated from each other by pulling at least one of the separable portions.

17. The mat of claim 15 wherein the cover means are configured to facilitate separation of the separable portions.

18. The mat of claim 15 wherein the cover means comprises a plurality of selectively-removable sheets.

19. The mat of claim 18 wherein at least some of the sheets are disposed over other ones of the sheets.

20. The mat of claim 18 wherein the cover means comprises a pad of the sheets disposed in overlying relation and attached to an edge of the pad.

21. The mat of claim 15 wherein the cover means is removably connected to the body.

22. The mat of claim 15 wherein the length of the body is larger than, but about, an entire length of the infant.

23. The mat of claim 15 wherein the cover means is configured to inhibit human waste from passing through the cover means.

24. The mat of claim 15 wherein the body is configured to be collapsible.

25. The mat of claim 15 wherein the cover means is configured to have a first of the separable portions disposed under the infant and above a second of the separable portions and the body during a first usage of the mat and to be removed, leaving the second of the separable portions disposed for direct contact with the infant during a second usage of the mat.

26. The mat of claim 15 wherein the cover means comprises a dispenser configured to dispense the separable portions of protective covering material, wherein the dispenser is removably connected to the body and is configured to be portable.

27. An infant change mat comprising:

a body sized to receive an infant, the body having a length at least about a length of an infant from the infant's head to the infant's buttocks and a width that is wider than about a width of a torso of the infant to accommodate the infant lying on the infant's back on the body; and a plurality of selectively-removable water-resistant sheets removably connected to the body and configured to be disposed over at least a portion of the body and to have a first of the sheets be disposed under the at least a portion of the infant during a first usage of the mat for changing the diaper of the infant, be soiled, and be discarded, and to have a second of the sheets be disposed under the at least a portion of the infant during the first usage and during a second usage of the mat for changing another diaper of the infant, be soiled, and be discarded;

wherein the sheets are configured to inhibit human waste from passing through the sheets into contact with the body;

wherein the body and the sheets are configured to be portable.

28. The mat of claim 27 wherein the sheets are stacked, connected to a base that is removably connected to the body, and configured to be separated from the base.

29. The mat of claim 27 further comprising a dispenser configured to store and dispense the sheets, the dispenser being removably connected to the body.

* * * * *